US006536446B2

(12) United States Patent
Kimura

(10) Patent No.: US 6,536,446 B2
(45) Date of Patent: Mar. 25, 2003

(54) HAIR CLIP

(75) Inventor: Yoshio Kimura, Yao (JP)

(73) Assignees: Lucky Corporation Co., Ltd., Yao (JP); Toyo Shinku Co., Ltd., Osaka (JP)

( * ) Notice: Subject to any disclaimer, the term of this patent is extended or adjusted under 35 U.S.C. 154(b) by 0 days.

(21) Appl. No.: 09/948,573

(22) Filed: Sep. 10, 2001

(65) Prior Publication Data

US 2002/0108626 A1 Aug. 15, 2002

(30) Foreign Application Priority Data

Feb. 14, 2001 (JP) ..... 2001-037339

(51) Int. Cl.[7] ..... A45D 8/20; A45D 8/00; A45D 8/22

(52) U.S. Cl. ..... 132/277; 132/278; 132/276

(58) Field of Search ..... 132/277, 278, 132/273, 276, 279; 24/3.11, 3.12, 3.13, 5.23, 4.82

(56) References Cited

U.S. PATENT DOCUMENTS 3,604,067 A * 9/1971 Brown ..... 24/67 R 5,318,292 A * 6/1994 De Marco ..... 273/32 B

* cited by examiner

*Primary Examiner*—John J. Wilson
*Assistant Examiner*—Robyn Kieu Doan
(74) *Attorney, Agent, or Firm*—Oblon, Spivak, McClelland, Maier & Neustadt, P.C.

(57) ABSTRACT

A hair clip comprises a first clip body with one end thereof formed as a first handling portion and the other end formed as a first hair clipping portion, a second clip body with one end thereof formed as a second handling portion and the other end formed as a second hair clipping portion, a coupler for coupling the first clip body and the second clip body with each other so that the first hair clipping portion and the second hair clipping portion are made opened and closed by operating the first handling portion and the second handling portion, and an urging device for urging the first hair clipping portion and the second hair clipping portion in a direction of closing them, and at least one of the first handling portion and the second handling portion has a first part made of a first material and a second part made of a second material as a flexible material more flexible than the first material.

20 Claims, 3 Drawing Sheets

FIG. 5
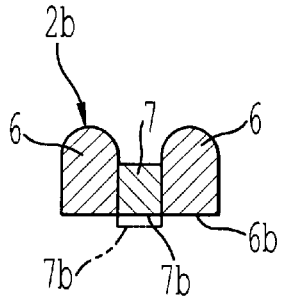
FIG. 6
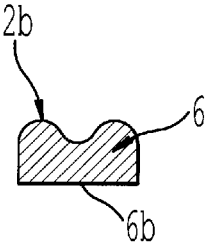
FIG. 7
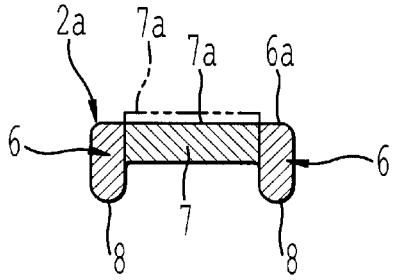
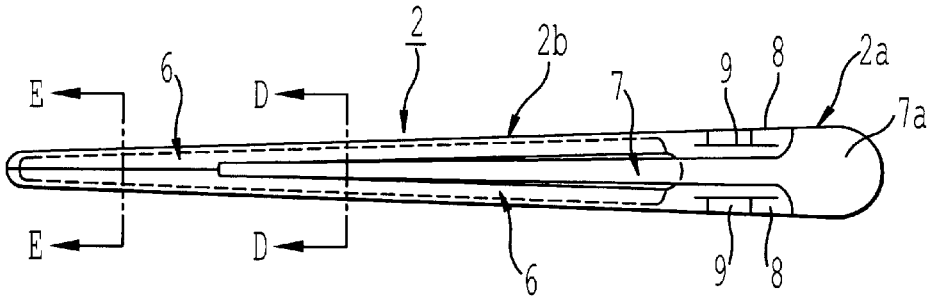
FIG. 8
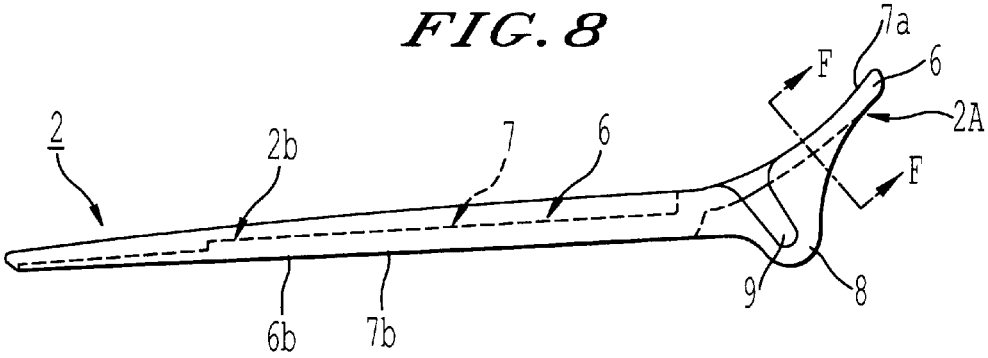
FIG. 9

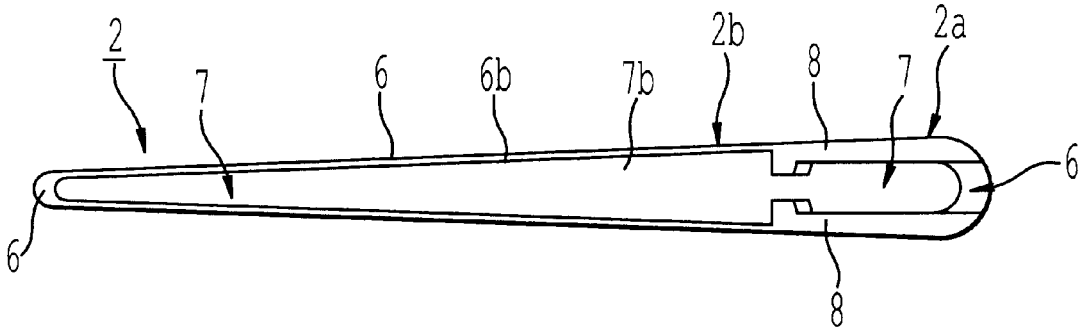
FIG. 10
FIG. 11
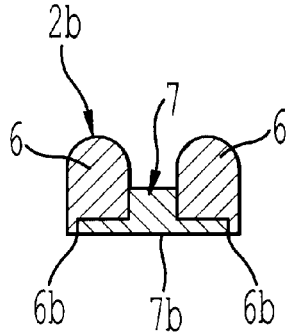
FIG. 12
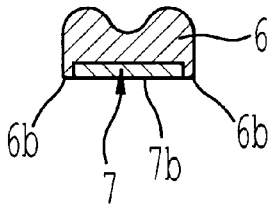
FIG. 13
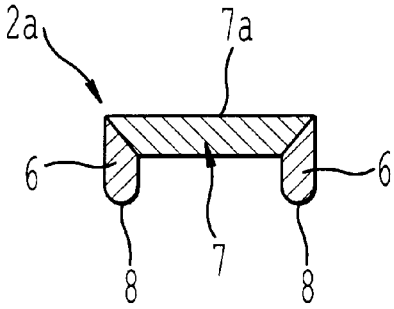

HAIR CLIP

BACKGROUND OF THE INVENTION

1. Field of the Invention

The present invention relates to a hair clip.

2. Description of the Related Art

A hair clip has a structure in which a portion of clipping hairs is opened to clip hair by an operation with fingers. Such a hair clip is used not only privately in a home but also professionally in a beauty parlor. In the beauty parlor, sometimes a number of hair clips are used in a short time.

The hair clip is provided with a spring so as to maintain a closed state thereof with a force of the spring. This requires fingers to perform opening and closing operation of the hair clip with a considerably large force against the force of the spring. However, a conventional hair clip is formed with rigid plastic which causes fingers to slip easily when performing opening and closing operation.

Use of a large number of clips of such a kind in a beauty parlor causes hairdressers to have fatigued fingers to result in reduction in efficiency of their work.

As one of countermeasures to the above, therefore, a flexible material may be employed as the hair clip material. The hair clip, however, must have structural rigidity to some extent. This will therefore cause a problem when employing the flexible material. Namely, the hair clip is required to have rigidity so as not to cause damage by operations of opening and closing, and some extent of strength for holding a spring. In addition, the rigidity is also required for securely clipping hairs.

SUMMARY OF THE INVENTION

Accordingly, it is an object of the present invention to provide a hair clip which can prevent slip while ensuring rigidity.

According to the present invention, the above object can be achieved by. a hair clip comprising a first clip body with one end thereof formed as a first handling portion and the other end formed as a first hair clipping portion, a second clip body with one end thereof formed as a second handling portion and the other end formed as a second hair clipping portion, a coupler for coupling the first clip body and the second clip body with each other so that the first hair clipping portion and the second hair clipping portion are made opened and closed by operating the first handling portion and the second handling portion, and an urging device for urging the first hair clipping portion and the second hair clipping portion in a direction of closing them, wherein at least one of the first handling portion and the second handling portion has a first part made of a first material and a second part made of a second material as a flexible material more flexible than the first material.

At least one of the first and the second handling portions having the second part made of the flexible second material allows the finger to touch softly with the handling portion. This can prevent the finger from slipping to make the fingers of the user of the hair clip get less fatigued, while the rigidity of the handling portion can be ensured by providing the first material more rigid than the second material. As a whole, the handling portion can prevent slip while ensuring rigidity.

Moreover, each of the first handling portion and the second handling portion has a finger touching face touched by a finger when handled. The whole or a part of the finger touching face of at least one of the first handling portion and the second handling portion is preferably made of the second material as a flexible material. By employing such a constitution, the handling portion is allowed to get fit to a skin of a fingertip, to cause no slip, to facilitate opening and closing operation, and to reduce extent of fatigue of fingers even when the hair clip is frequently used.

The finger touching face made of the second material is preferably formed with a periphery of the second material as a flexible material surrounded by the first material being more rigid than the second material. Since the fingertip does not so strongly touch to the periphery of the finger touching face, no problem is caused even though the periphery is surrounded by the rigid first material. Hence, the above form can be provided as being best suited for ensuring rigidity while preventing slip.

In addition, according to the other aspect of the invention, in the above hair clip, at least one of the first hair clipping portion and the second hair clipping portion has a first part made of a first material and a second part made of a second material as a flexible material more flexible than the first material.

The hair clipping portion having the second part made of the flexible second material provides the second part as a slip-proof for clipping hairs to allow the hair clip to securely clip and hold the hairs without causing any slip, while the rigidity of the hair clipping portion can be ensured by the first material being more rigid than the second material. As a whole, the hair clipping portion can prevent slip while ensuring rigidity.

Each of the first hair clipping portion and the second hair clipping portion has a hair clipping face touching hairs when clipping the hairs. The whole or a part of the hair clipping face of at least one of the first handling portion and the second handling portion is preferably made of the second material as a flexible material. Such a constitution can ensure a slip-proof function of the hair clipping portion together with allowing the hair clipping portion to have an ensured strength and a clipping force.

Further, the hair clipping face made of the second material is made to have a constitution in which a periphery of the second material as a flexible material is surrounded by the first material being more rigid than the second material. This can not only ensure a strength of the hair clipping portion but also make the hairs easily move apart from the hair clip when the hair clip is opened for taking the hairs away therefrom to allow easy and efficient hairdressing work.

BRIEF DESCRIPTION OF THE DRAWINGS

FIG. 5 is an enlarged cross sectional view of the clip body taken along line A—A in FIG. 2;

FIG. 6 is an enlarged cross sectional view of the clip body taken along line B—B in FIG. 2;

FIG. 7 is an enlarged cross sectional view of the clip body taken along line C—C in FIG. 3;

FIG. 8 is a plan view showing a clip body made of synthetic resin as a principal part of the hair clip according to a second embodiment of the present invention;

FIG. 9 is a side view showing the clip body of the hair clip in the second embodiment;

FIG. 10 is a bottom view showing the clip body of the hair clip in the second embodiment;

FIG. 11 is an enlarged cross sectional view of the clip body taken along line D—D in FIG. 8;

FIG. 12 is an enlarged cross sectional view of the clip body taken along line E—E in FIG. 8; and FIG. 13 is an enlarged cross sectional view of the clip body taken along line F—F in FIG. 9;

DESCRIPTION OF THE PREFERRED EMBODIMENTS

In the following, embodiments of the present invention will be explained with reference to the drawings.

Figure 1:
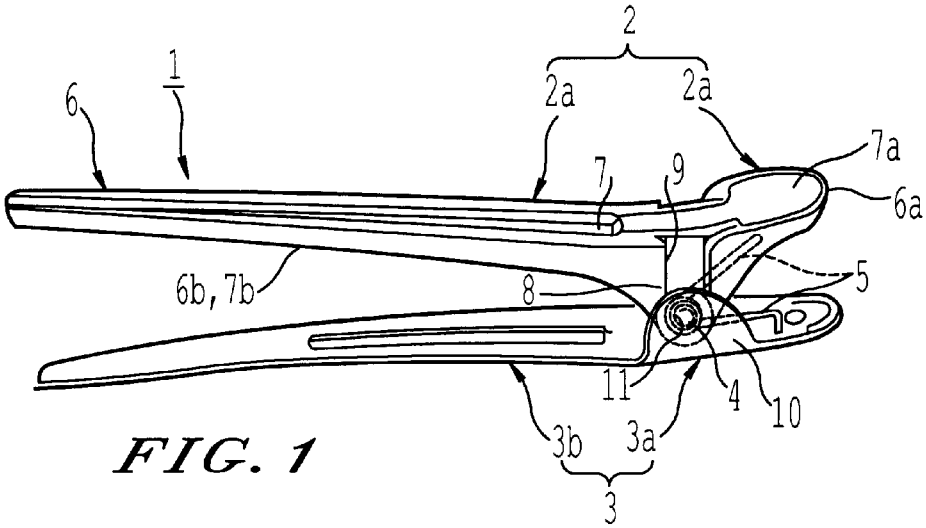
FIG. 1 is a whole perspective view showing a first embodiment of a hair clip according to the present invention.
Figure 2:
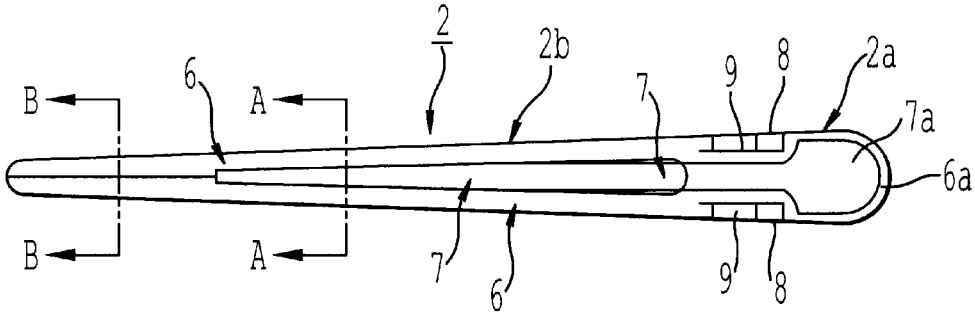
FIG. 2 is a plan view showing a clip body made of synthetic resin in the first embodiment of the hair clip.
Figure 3:
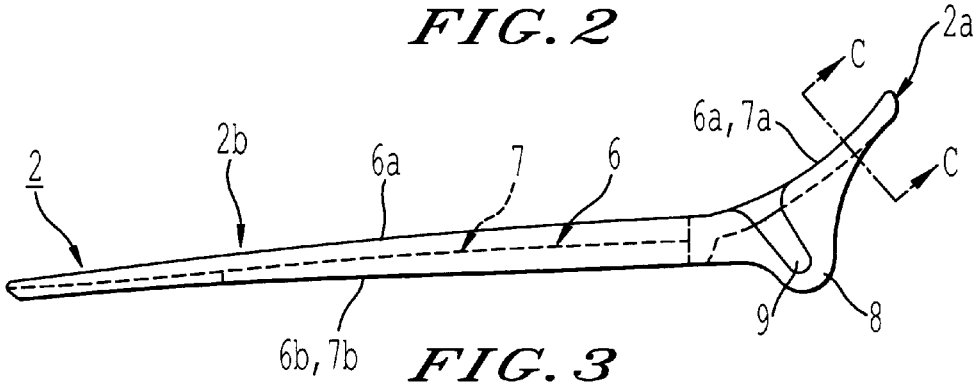
FIG. 3 is a side view showing the clip body of the hair clip in the first embodiment.
Figure 4:
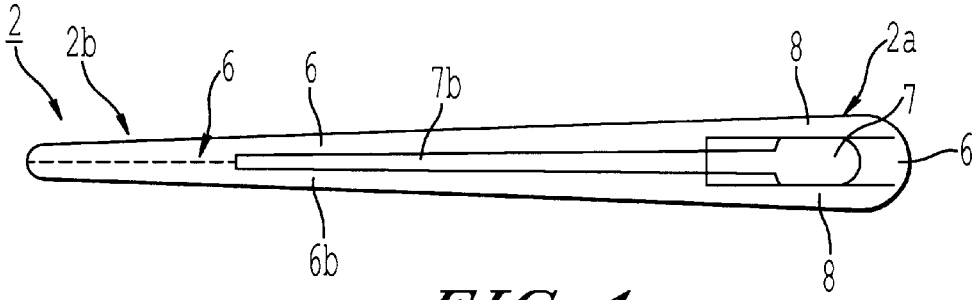
FIG. 4 is a bottom view showing the clip body of the hair clip in the first embodiment.

FIG. 1 through FIG. 7 show a first embodiment of the hair clip 1 according to the present invention. FIG. 1 is a perspective view showing a first embodiment of a hair clip according to the present invention. FIG. 2 through FIG. 4 are a plan view, a side view, and a bottom view, respectively, showing a clip body made of synthetic resin in the first embodiment of the hair clip. FIG. 5 through FIG. 7 are enlarged cross sectional views of the first clip body 2 taken along lines A—A and B—B in FIG. 2, and line C—C in FIG. 3, respectively.

As shown in the Figs, the hair clip 1 comprises a first clip body 2 made of synthetic resin, a second clip body 3 made of metal, a lateral shaft 4 and a coil spring 5.

One end of the first clip body 2 is formed as a first handling portion 2*a* and the other end is formed as a first hair clipping portion 2*b*. One end of the second clip body 3 is formed as a second handling portion 3*a* and the other end is formed as a second hair clipping portion 3*b*. The lateral shaft 4 is for coupling the first clip body 2 and the second clip body 3 with each other on the side of the first handling portion 2*a* and the second handling portion 3*a*. The first clip body 2 and the second clip body 3 are coupled so that they are made to face each other with the first hair clipping portion 2*b* and the second hair clipping portion 3*b* made opened and closed around the lateral shaft 4 in the directions opposite to each other by operating the first handling portion and the second handling portion. The coil spring 5 is provided as urging means for urging the first hair clipping portion 2*b* and the second hair clipping portion 3*b* inward in the direction opposite to each other.

The first clip body 2 is formed with the first hair clipping portion 2*b* long and narrowly extending from the first handling portion 2*a* at one end. The second clip body 3 is also formed with the second hair clipping portion 3*b* long and narrowly extending from the second handling portion 3*a* at one end.

The first clip body 2 is integrally formed with a first material 6 provided on a peripheral side (first part) and a second material 7 provided on an inside (second part). The first material 6 is made of hard synthetic resin (rigid synthetic resin) and the second material 7 is made of synthetic resin with a less hardness than that of the first material 6 (flexible synthetic resin). In the first embodiment, polycarbonate resin was used as the first material 6 on the peripheral side and elastomer was used as the second material 7 on the inside.

In the present invention, there is no particular limitation on the material for the first material 6 and the second material 7 both constituting the first clip body 2. As the rigid resin for the first material 6, phenolic resin, acrylic resin, nylon, polyacetal, polycarbonate, ABS resin, polypropylene (PP), polyethylene resin, rigid polyvinyl chloride, and the like may be employed. Hardness of the order of 100 or more Rockwell R is preferably taken as a measure of the hardness of the rigid resin. The hardness in a range of 100 to 140 Rockwell R is further preferable. Moreover, metal can be used as the first material 6.

As the flexible resin for the second material 7, flexible nylon, olefin elastomer, polyurethane elastomer, styrene elastomer, PVC elastomer, polyester elastomer, or polybutadiene may be employed. In addition to this, ethylene-vinyl. acetate copolymer (EVA) and flexible polyvinyl chloride may also be employed. Hardness of the order of 60 or less Shore D is preferably taken as a measure of the hardness of the flexible resin. The hardness in a range of 10 to 60 Shore D is further preferable.

The first clip body 2 has a peripheral side part formed with the more rigid first material 6, inside which there is formed a longitudinally extending groove-like second material fitting part. The fitting part is made opened in the first handling portion 2*a* and the first hair clipping portion 2*b*. Into the second material fitting part, the second material 7 is poured to integrally form the first clip body 2 together with the first material 6 on the peripheral side. In this way, the first clip body 2 is provided which is as a whole formed with the first material 6 arranged on both sides in the width direction thereof and with the second material 7 positioned at the central portion in the width direction. The clip body 2 is integrally formed with the first material 6 and the second material 7 to allow improvement in the quality and productivity thereof with reduction in the production cost thereof. Furthermore, in each of the first handling portion 2*a* and the first hair clipping portion 2*b*, the second material 7 is integrally formed with the first material 6 to provide higher strength.

The first clip body 2 is also provided with a pair of coupling pieces 8, 8 sharing shaft supporting brackets in the vicinity of the handling portion 2*a*. The coupling pieces 8, 8 are provided so as to position on both sides of the clip body 2 in the width direction thereof and so as to be projected in parallel with each other on the side opposite to the clip body 3.

The coupling pieces 8, 8 are made of the rigid first material 6. Each of the coupling pieces 8, 8 has a through holes 9, 9 in a shape of a cutout so as to be opposite to each other for inserting the lateral shaft 4 in the right to left direction. This can not only ensure the rigidity and strength of the handling portion 2*a* but also reliably hold the coil spring 5 in stable.

Each of the handling portions 2*a* and 3*a* has a finger touching face provided on a side that does not face to each other. The finger touching faces are normally operated with a thumb and an index finger pressing the first and second handling portions 2*a* and 3*a* so as to bring them near against the urging force of the coil spring 5, by which the hair clipping portions 2*b* and 3*b* are made open.

The finger touching face of the first handling portion 2*a* is formed with the periphery of the second material 7 as a flexible material surrounded by the first material 6 being more rigid than the second material 7. The second material 7 of the finger touching face occupies most of the whole finger touching area. This allows the finger touching face to easily get fit to a skin of a fingertip of the operator, the hair clip to be secured to hairs without causing any slip of the fingertip, and opening and closing operation to be much facilitated. The flexible second material 7 can prevent the skin of the fingertip from injury and can reduce fatigue of fingers with hands being free from getting hurt even when the hair clips are frequently used.

Furthermore, in the finger touching face of the first handling portion 2*a,* as shown by a solid line in FIG. 7, a surface 7*a* of the second material 7 constituting the central part and a surface 6*a* of the first material 6 constituting the outer part are made flush with each other to give a fingertip a sensation of getting good fit to the face.

Each of faces on the facing sides of the first and second hair clipping portions 2*b* and 3*b* is taken as a hair clipping face for clipping hairs.

The first hair clipping portion 2*b* of the first clip body 2 is provided with rigidity and a strength for making it possible to ensure a sufficient clipping force due to the first material 6 on the peripheral side. The second material fitting part is filled with the second material 7 to form a surface 7*b* of the second material 7 occupying substantially a half of the hair clipping face at central area thereof. The hair clipping face is formed as shown by a solid line in FIG. 5 with the surface 7*b* of the second material 7 and a surface 6*b* of the first material 6 made flush with each other. Therefore, when hairs are clipped by the hair clipping portion 2*b,* the flexible second material 7 positioned inside exhibits a slip-proof function for allowing the hair securely clipped and secured. Moreover, the peripheral side made of the rigid first material 6 allows the hair to be hardly entangled around the hair clip when the hair clip is opened for being removed from the hair. This allows easy and efficient hairdressing work.

As explained above, the clip body 2 is well constituted with the rigid first material 6 used for the parts which requires ensured rigidity and the flexible second material 7 used for the parts which requires to be slip-proof.

The second clip body 3 is, as explained above, made of metal, an aluminum alloy, for example. The second clipping portion 3*b* has a length made equal to that of the first clip body 2. The second handling portion 3*a* has a length a little longer than that of the first handling portion 2*a*. On both sides in a width direction of the second handling portion 3*a,* there are formed a pair of coupling pieces 10, 10 bent in parallel with each other. The coupling pieces 10, 10 are provided so that they are positioned on the outside of the coupling pieces 8 of the first clip body 2 while facing the coupling pieces 8. Each of the coupling pieces 10, is provided with a shaft hole 11 for inserting the lateral shaft 4 in the right to left direction, i.e. in the direction of the width of the clip body 3.

The clip bodies 2 and 3 are coupled to be integrated by inserting the lateral shaft 4 into the shaft holes 9 and 11 provided in the coupling pieces 8 and 10, respectively, so that both of the first and second clipping portions 2*b* and 3*b* are moved in the direction opposite to each other for being opened and closed.

The first material 6 and the second material 7 can be differently colored from each other. For example, with the first material 6 colored in white and the second material 7 colored in red, the hair clip 1 can be provided as being high in a design and in a fashion, practical as well as distinctive, and further excellent in quality. Here, colors of the first and second materials 6 and 7 different in deepness are also taken as different colors even though the colors are in the same color group.

By forming the second material fitting part of the first clip body 2 so as to penetrate the body 2 in the direction of facing the second clip body 3, the second material 7 appears on both of the front and rear faces of the first clip body 2. Thus, the color of the second material 7 can be emphasized. In particular, the fitting part made to penetrate the clip body 2 in the first hair clipping portion 2*a,* occupying most of the part of the clip body 2, provides the clip body 2 as being excellent in a design.

According to the above first embodiment, the handling portion 2*a* of the first clip body 2 can easily get fit to a skin of a fingertip of the operator, can be secured by the fingertip without causing any slip thereof and can much facilitate opening and closing operation. The second material 7 in the central portion strongly pressed by the fingertip of the operator, being flexible as explained above, can prevent the skin of the fingertip from injury, and can reduce fatigue of fingers with hands being free from getting hurt even when the hair clips are frequently used. Furthermore, the coupling pieces 8 and the peripheral side of the first handling portion 2*a,* being constituted by the first material 6 made of rigid material, provide sufficient strength and rigidity. Therefore, the coil spring 5 can be held in stable and reliably without any fear of being damaged even though the hair clip is frequently used, which ensures excellent durability.

Moreover, the first hair clipping portion 2*b* of the first clip body 2 is provided with a rigidity and a strength for ensuring a sufficient clipping force due to the first material 6 on the peripheral side made of rigid synthetic resin. Therefore, when hairs are clipped by the hair clipping portion 2*b,* the flexible second material 7 exhibits a slip-proof function for allowing the hair to be securely clipped and secured. Furthermore, the peripheral side of the clipping portion 2*b* made of the rigid synthetic resin allows the hairs to easily move apart from the clipping portion 2*b* of the clip body 2 when the hair clip 1 is opened, which can improve workability.

In the above first embodiment, in the finger touching face of the first handling portion 2*a,* the surface 6*a* of the first material 6 and the surface 7*a* of the second material 7 are made flush with each other as shown by solid lines in FIG. 7. Moreover, in the hair clipping face of the hair clipping portion 2*b,* the surface 6*b* of the first material 6 and the surface 7*b* of the second material 7 are made flush with each other as shown by solid lines in FIG. 5. However, as shown by a two-dot chain lines in FIG. 7 and FIG. 5, the surfaces 7*a* and 7*b* of the second material 7 may be made a little protruded (of the order of 0.5 mm) from the surface 6*a* and 6*b* of the first material 6, respectively.

FIG. 8 through FIG. 13 show a principal part of a hair clip, a first clip body 2, as a second embodiment according to the present invention. FIG. 8 through FIG. 10 are a plan view, a side view, and a bottom view, respectively, showing the first clip body 2 in the second embodiment. FIG. 11 through FIG. 13 are enlarged cross sectional views of the first clip body 2 taken along lines D—D and E—E in FIG. 8 and line F—F in FIG. 9, respectively.

The second embodiment differs from the first embodiment in that the second material 7 of the handling portion 2*a* of the first clip body 2 is provided over almost all of the finger touching face side. The second embodiment further differs in that the second material 7 of the hair clipping portion 2*b* is provided over almost all of the face opposite to the second clip body 3 of the hair clipping portion 2*b*. Nevertheless, the equivalent working-effect can be expected to that of the first embodiment. Thus, constituents common to those in the first embodiment will be denoted by the same reference numerals and characters as those in FIG. 1 through FIG. 7 with explanations thereof omitted.

In the second embodiment, the second material 7 can be provided on the whole surface of the finger touching face side and the whole surface of the hair clipping face side.

It should be understood that the present invention is not limited to the above embodiments. For example, both of the first and second clip bodies 2 and 3 may be made of resin. The second clip body 3 may be also integrally formed with two kinds of the first and second materials 6 and 7. Moreover, the first and second materials 6 and 7 may be separately molded before being assembled into the first and second clip bodies 2 and 3. Furthermore, design on the shapes and structures of the first and second clip bodies 2 and 3 may be modified as desired. In addition, there may be provided projections on one or both of the hair clipping faces of the hair clipping portion 2*b* for making the faces slip-proof.

What is claimed is:

1. A hair clip comprising:

a first clip body with one end thereof formed as a first handling portion and the other end formed as a first hair clipping portion;

a second clip body with one end thereof formed as a second handling portion and the other end formed as a second hair clipping portion;

means for coupling the first clip body and the second clip body with each other so that the first hair clipping portion and the second hair clipping portion are made opened and closed by operating the first handling portion and the second handling portion; and means for urging the first hair clipping portion and the second hair clipping portion in a direction of closing them, at least one of the first handling portion and the second handling portion having a first part made of a first material and a second part made of a second material as a flexible material more flexible than the first material.

2. The hair clip as claimed in claim 1, wherein each of the first handling portion and the second handling portion has a finger touching face touched by a finger when handled, the whole or a part of the finger touching face of at least one of the first handling portion and the second handling portion being made of the second material as a flexible material.

3. The hair clip as claimed in claim 2, wherein the finger touching face made of the second material is formed with a periphery of the second material as a flexible material surrounded by the first material being more rigid than the second material.

4. The hair clip as claimed in claim 1, wherein the first material is a rigid resin and the second material is a flexible resin.

5. The hair clip as claimed in claim 1, wherein the second material is elastomer and the first material is a material being more rigid than the second material.

6. The hair clip as claimed in claim 1, wherein the first part made of the first material and the second part made of the second material are integrally formed to constitute at least one of the first clip body and the second clip body.

7. The hair clip as claimed in claim 1, wherein the first part made of the first material and the second part made of the second material are independently formed and are assembled together, thereby constituting at least one of the first clip body and the second clip body.

8. The hair clip as claimed in claim 1, wherein the first material and the second material are differently colored from each other.

9. The hair clip as claimed in claim 1, wherein one of the first clip body and the second clip body is made of metal.

10. The hair clip as claimed in claim 1, wherein the coupling means includes a coupling piece provided for each of the first clip body and the second clip body, the coupling piece being made of the first material in at least one of the first clip body and the second clip body having the first part and the second part.

11. A hair clip comprising:

a first clip body with one end thereof formed as a first handling portion and the other end formed as a first hair clipping portion;

a second clip body with one end thereof formed as a second handling portion and the other end formed as a second hair clipping portion;

means for coupling the first clip body and the second clip body with each other so that the first hair clipping portion and the second hair clipping portion are made opened and closed by operating the first handling portion and the second handling portion; and means for urging the first hair clipping portion and the second hair clipping portion in a direction of closing them, at least one of the first hair clipping portion and the second hair clipping portion having a first part made of a first material and a second part made of a second material as a flexible material more flexible than the first material.

12. The hair clip as claimed in claim 11, wherein each of the first hair clipping portion and the second hair clipping portion has a hair clipping face touching hairs when clipping the hairs, the whole or a part of the hair clipping face of at least one of the first hair clipping portion and the second hair clipping portion being made of the second material as a flexible material.

13. The hair clip as claimed in claim 12, wherein the hair clipping face made of the second material is formed with a periphery of the second material as a flexible material surrounded by the first material being more rigid than the second material.

14. The hair clip as claimed in claim 11, wherein the first material is a rigid resin and the second material is a flexible resin.

15. The hair clip as claimed in claim 11, wherein the second material is elastomer and the first material is a material being more rigid than the second material.

16. The hair clip as claimed in claim 11, wherein the first part made of the first material and the second part made of the second material are integrally formed to constitute at least one of the first clip body and the second clip body.

17. The hair clip as claimed in claim 11, wherein the first part made of the first material and the second part made of the second material are independently formed and are assembled together, thereby constituting at least one of the first clip body and the second clip body.

18. The hair clip as claimed in claim 11, wherein the first material and the second material are differently colored from each other.

19. The hair clip as claimed in claim 11, wherein one of the first clip body and the second clip body is made of metal.

20. The hairclip as claimed in claim 11, wherein the coupling means includes a coupling piece provided for each of the first clip body and the second clip body, the coupling piece being made of the first material in at least one of the first clip body and the second clip body having the first part and the second part.

* * * * *